US011192385B2

(12) United States Patent
Nakajima

(10) Patent No.: US 11,192,385 B2
(45) Date of Patent: Dec. 7, 2021

(54) LIQUID DISCHARGING APPARATUS

(71) Applicant: SEIKO EPSON CORPORATION, Tokyo (JP)

(72) Inventor: Yoshinori Nakajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/749,673

(22) Filed: Jan. 22, 2020

(65) Prior Publication Data

US 2020/0230972 A1 Jul. 23, 2020

(30) Foreign Application Priority Data

Jan. 23, 2019 (JP) ..... JP2019-009155

(51) Int. Cl.
*B41J 2/18* (2006.01)

(52) U.S. Cl.
CPC ..... *B41J 2/18* (2013.01)

(58) Field of Classification Search
CPC ..... B41J 2/18
See application file for complete search history.

(56) References Cited

U.S. PATENT DOCUMENTS

2016/0288518 A1* 10/2016 Ando ..... B41J 2/18

FOREIGN PATENT DOCUMENTS

JP 2014-172324 A 9/2014
JP 2014172324 A2 * 9/2014

* cited by examiner

*Primary Examiner* — Jason S Uhlenhake
(74) *Attorney, Agent, or Firm* — Workman Nydegger

(57) ABSTRACT

A liquid discharging apparatus has: a liquid storing chamber storing a liquid to be discharged from a discharge opening; a supply flow path supplying the liquid to the liquid storing chamber; a discharge flow path discharging the liquid from the liquid storing chamber; a circulation controller controlling a circulation operation to circulate, to the supply flow path, the liquid discharged through the discharge flow path; and a discharge controller controlling a discharge operation to discharge the liquid from the discharge opening. The circulation controller lowers the flow velocity of the liquid in the circulation operation below the flow velocity of the liquid in the circulation operation with the discharge operation being in progress, after which the circulation controller stops the circulation operation.

12 Claims, 13 Drawing Sheets

LIQUID DISCHARGING APPARATUS

The present application is based on, and claims priority from JP Application Serial Number 2019-009155, filed Jan. 23, 2019, the disclosure of which is hereby incorporated by reference herein in its entirety.

BACKGROUND

1. Technical Field

The present disclosure relates to a liquid discharging apparatus.

2. Related Art

A technology proposed in related art discharges a liquid such as, for example, an ink from a discharge opening. JP-A-2014-172324, for example, discloses a circulation-type liquid discharging apparatus that circulates a liquid through a ring-shaped flow path that includes a liquid discharging head for discharging a liquid and a tank for storing an ink.

When the circulation of a liquid is stopped in the circulation-type liquid discharging apparatus, the inertial force of the liquid may cause an excessively negative pressure in a liquid chamber in the liquid discharging head. When an excessively negative force is generated in the liquid chamber, outside air is inhaled through the discharge opening. As a result, bubbles may enter the liquid.

SUMMARY

To solve the above problem, a liquid discharging apparatus according to a preferred aspect of the present disclosure has: a liquid storing chamber that stores a liquid to be discharged from a discharge opening; a supply flow path through which the liquid is supplied to the liquid storing chamber; a discharge flow path through which the liquid is discharged from the liquid storing chamber; a circulation controller that controls a circulation operation to circulate, to the supply flow path, the liquid discharged through the discharge flow path; and a discharge controller that controls a discharge operation to discharge the liquid from the discharge opening. The circulation controller lowers the flow velocity of the liquid in the circulation operation below the flow velocity of the liquid in the circulation operation with the discharge operation being in progress, after which the circulation controller stops the circulation operation.

A liquid discharging apparatus according to a preferred aspect of the present disclosure has: a liquid storing chamber that stores a liquid to be discharged from a discharge opening; a supply flow path through which the liquid is supplied to the liquid storing chamber; a discharge flow path through which the liquid is discharged from the liquid storing chamber; a circulation controller that controls a circulation operation to circulate, to the supply flow path, the liquid discharged through the discharge flow path; and a discharge controller that controls a discharge operation to discharge the liquid from the discharge opening. The circulation controller raises the pressure of the liquid in the liquid storing chamber above the pressure of the liquid in the liquid storing chamber with the discharge operation being in progress, after which the circulation controller stops the circulation operation.

A liquid discharging apparatus according to a preferred aspect of the present disclosure has: a liquid storing chamber that stores a liquid to be discharged from a discharge opening; a supply flow path through which the liquid is supplied to the liquid storing chamber; a discharge flow path through which the liquid is discharged from the liquid storing chamber; a circulation controller that controls a circulation operation to circulate, to the supply flow path, the liquid discharged through the discharge flow path; and a discharge controller that controls a discharge operation to discharge the liquid from the discharge opening. The circulation controller lowers the inertial force of the liquid, the inertial force being generated when the circulation operation has been stopped, below the inertial force of the liquid, the inertial force being generated when the circulation operation has been stopped with the discharge operation being in progress, after which the circulation controller stops the circulation operation.

DESCRIPTION OF EXEMPLARY EMBODIMENTS

First Embodiment

Figure 1:
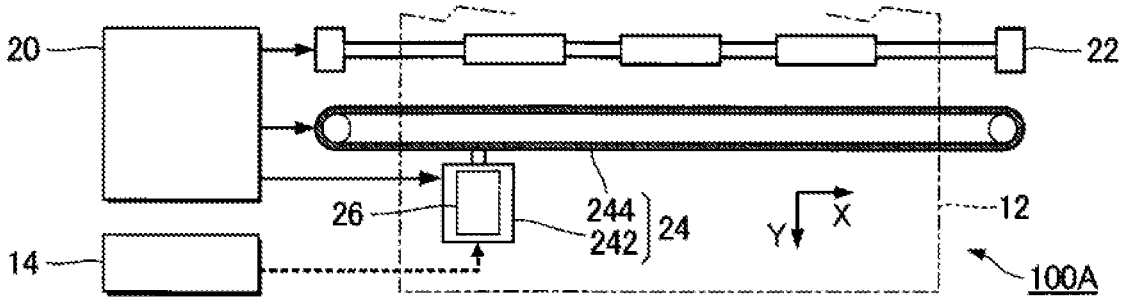
FIG. 1 is a block diagram illustrating the structure of a liquid discharging apparatus according to a first embodiment.

FIG. 1 illustrates the structure of a liquid discharging apparatus 100A according to a first embodiment. The liquid discharging apparatus 100A in the first embodiment is an ink jet printing apparatus that discharges an ink, which is an example of a liquid, to a medium 12. Although the medium 12 is typically a print sheet, any material eligible for printing such as a resin film or cloth is used as the medium 12. As illustrated in FIG. 1, the liquid discharging apparatus 100A includes a liquid container 14 that stores an ink. Examples of the liquid container 14 are a cartridge detachably mounted in the liquid discharging apparatus 100A, a bag-like ink pack formed from a flexible film, and an ink tank that can be refilled with ink.

As illustrated in FIG. 1, the liquid discharging apparatus 100A has a control unit 20, a transport mechanism 22, and a moving mechanism 24, and a liquid discharging head 26. The control unit 20 includes a processing circuit such as, for example, a central processing unit (CPU) or a field programmable gate array (FPGA), and also includes a storage circuit such as a semiconductor memory. The control unit 20 controls the elements constituting the liquid discharging apparatus 100A. The transport mechanism 22 transports the medium 12 in the Y direction under control of the control unit 20.

The moving mechanism 24 reciprocates the liquid discharging head 26 in the X direction under control of the control unit 20. The X direction intersects the Y direction, in which the medium 12 is transported. For example, the X direction and Y direction are orthogonal to each other. The moving mechanism 24 in the first embodiment has a transporting body 242, substantially in a box shape, that accommodates the liquid discharging head 26, and also has a transport belt 244 to which the transporting body 242 is secured. Another structure may also be used in which a plurality of liquid discharging heads 26 are mounted in the transporting body 242 or the liquid container 14 is mounted in the transporting body 242 together with the liquid discharging head 26.

The liquid discharging head 26 discharges ink supplied from the liquid container 14 from each of a plurality of discharge openings to the medium 12 under control of the control unit 20. When the liquid discharging head 26 discharges ink to the medium 12 while the transport mechanism 22 is transporting the medium 12 and the transporting body 242 repetitively reciprocates, an image is formed on the front surface of the medium 12.

Figure 2:
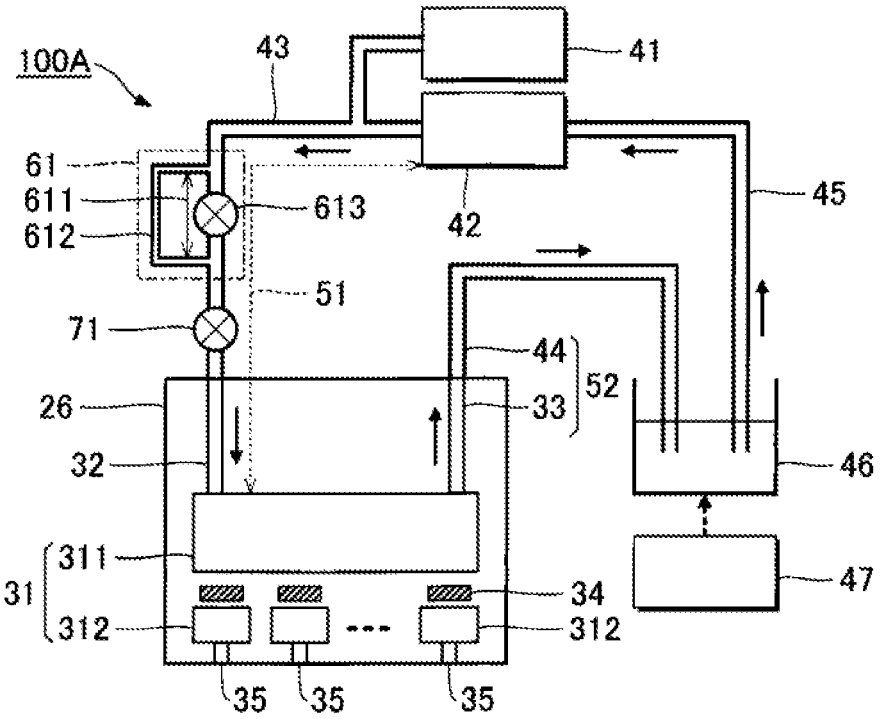
FIG. 2 illustrates ink flow paths in the liquid discharging apparatus.

FIG. 2 illustrates ink flow paths in the liquid discharging apparatus 100A. As illustrated in FIG. 2, the liquid discharging head 26 has a liquid storing chamber 31, an internal supply flow path 32, an internal discharge flow path 33, a plurality of driving elements 34, and a plurality of discharge openings 35. The liquid storing chamber 31 is an internal space in which ink is stored. The internal supply flow path 32 is a flow path through which ink is supplied to the liquid storing chamber 31. The internal discharge flow path 33 is a flow path through which ink is discharged from the liquid storing chamber 31. Specifically, ink that had supplied through the internal supply flow path 32 but has not discharged from the plurality of discharge openings 35 is discharged through the internal discharge flow path 33 to the outside of the liquid discharging head 26. The liquid storing chamber 31 includes a common liquid chamber 311 common to the plurality of discharge openings 35, and also includes a plurality of pressure chambers 312 communicating with the common liquid chamber 311. The internal supply flow path 32 and internal discharge flow path 33 communicate with the common liquid chamber 311 in the liquid storing chamber 31.

The pressure chamber 312 and driving element 34 are formed for each discharge opening 35. The pressure chamber 312 is a space communicating with the discharge opening 35. Each of the plurality of pressure chambers 312 is filled with ink supplied from the common liquid chamber 311. The driving element 34 varies the pressure of the ink in the pressure chamber 312. Examples that may be used as the driving element 34 are a piezoelectric element that deforms a wall surface of the pressure chamber 312 so as to vary the volume of the pressure chamber 312 and a heat generating element that heats the ink in the pressure chamber 312 so as to generate bubbles in the pressure chamber 312. When the driving element 34 varies the pressure in the pressure chamber 312, the ink in the pressure chamber 312 is discharged from the discharge opening 35.

In addition to the liquid discharging head 26 described above, the liquid discharging apparatus 100A has a pressure feeding mechanism 41, a circulating pump 42, an external supply flow path 43, an external discharge flow path 44, a circulation flow path 45, a storing container 46, and a pressure adjustor 47, as illustrated in FIG. 2.

The pressure feeding mechanism 41 applies pressure to the ink held in the liquid container 14 to expel the ink. That is, the pressure feeding mechanism 41 pumps ink. Examples that may be used as the pressure feeding mechanism 41 are a pressurizing mechanism that pressurizes the liquid container 14 so as to expel ink and a supply pump that inhales ink from the liquid container 14 and expels the ink. The ink expelled from the pressure feeding mechanism 41 is supplied to the external supply flow path 43.

The circulating pump 42 expels, from its discharge opening, ink supplied to the supply inlet of the circulating pump 42. The external supply flow path 43 is a tubular path through which the discharge opening of the circulating pump 42 and the internal supply flow path 32 in the liquid discharging head 26 communicate with each other. Ink expelled from the circulating pump 42 and ink expelled from the pressure feeding mechanism 41 are supplied to the liquid storing chamber 31 through the external supply flow path 43 and internal supply flow path 32. That is, the external supply flow path 43 and internal supply flow path 32 form a supply flow path 51 through which ink is supplied to the liquid storing chamber 31.

Figure 3:
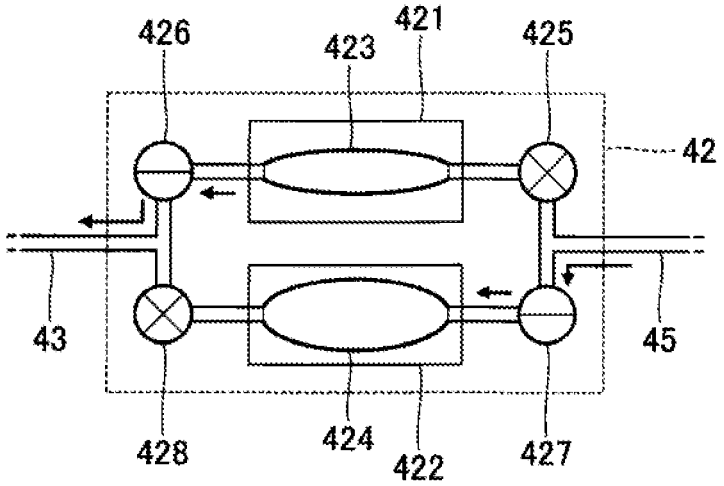
FIG. 3 illustrates the structure of a circulating pump and its first state.
Figure 4:
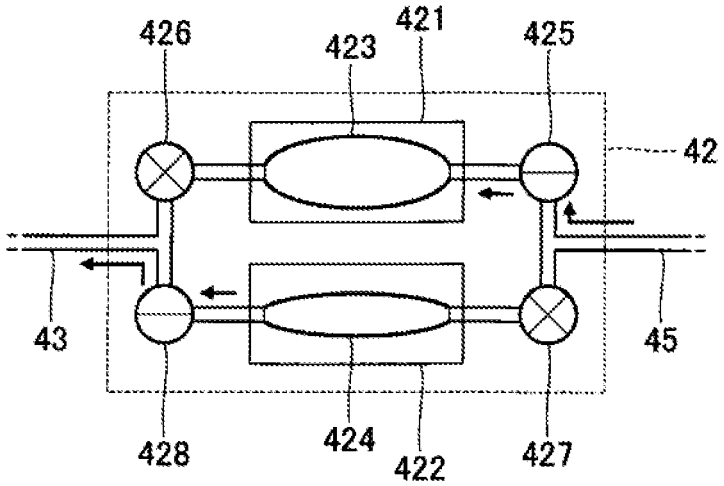
FIG. 4 illustrates the structure of the circulating pump and its second state.

FIGS. 3 and 4 schematically illustrate the specific structure and operation of the circulating pump 42. The circulating pump 42 has a first container 421, a second container 422, and four valves, denoted 425 to 428, which are opened and closed under control of the control unit 20.

The first container 421 and second container 422 are pressurized or depressurized under control of the control unit 20. A first pack 423, which can be deformed with ink stored, is provided in the first container 421. Similarly, a second pack 424, which can be deformed with ink stored, is provided in the second container 422.

A first valve 425 is disposed in a flow path through which the first pack 423 and circulation flow path 45 communicate with each other. A second valve 426 is disposed in a flow path through which the first pack 423 and external supply flow path 43 communicate with each other. A third valve 427 is disposed in a flow path through which the second pack 424 and circulation flow path 45 communicate with each other. A fourth valve 428 is disposed in a flow path through which the second pack 424 and external supply flow path 43 communicate with each other.

In a first state, illustrated in FIG. 3, in which the first valve 425 and fourth valve 428 are kept closed and the second valve 426 and third valve 427 are kept open, the first container 421 is pressurized and the second container 422 is depressurized. When the first container 421 is pressurized and the first pack 423 contracts, ink downstream of the first valve 425 flows out toward the external supply flow path 43. When the second container 422 is depressurized and the second pack 424 expands, ink upstream of the fourth valve 428 flows into the second pack 424 through the circulation flow path 45.

In a second state, illustrated in FIG. 4, in which the first valve 425 and fourth valve 428 are kept open and the second valve 426 and third valve 427 are kept closed, the first container 421 is depressurized and the second container 422 is pressurized. When the second container 422 is pressurized and the second pack 424 contracts, ink downstream of the third valve 427 flows out toward the external supply flow path 43. When the first container 421 is depressurized and the first pack 423 expands, ink upstream of the second valve 426 flows into the first pack 423 through the circulation flow path 45.

When the first state and second state are alternately entered so that one of them is changed to the other, ink is expelled from the circulation flow path 45 to the external supply flow path 43. The pressure feeding mechanism 41 can also have a structure similar to the structure of the circulating pump 42.

The storing container 46 in FIG. 2 stores ink. The external discharge flow path 44 is a tubular path through which the storing container 46 and the internal discharge flow path 33 in the liquid discharging head 26 communicate with each other. Ink discharged from the liquid storing chamber 31 is supplied to the storing container 46 through the internal discharge flow path 33 and external discharge flow path 44. That is, the external discharge flow path 44 and internal discharge flow path 33 form a discharge flow path 52 through which ink is discharged from the liquid storing chamber 31.

The circulation flow path 45 is a tubular path through which the storing container 46 and the supply inlet of the circulating pump 42 communicate with each other. That is, ink held in the storing container 46 is supplied to the supply inlet of the circulating pump 42 through the circulation flow path 45. As understood from the above description, ink that had held in the liquid storing chamber 31 but has not discharged from the discharge openings 35 circulates through the internal discharge flow path 33, external discharge flow path 44, storing container 46, circulation flow path 45, circulating pump 42, external supply flow path 43, internal supply flow path 32, and liquid storing chamber 31 in that order. That is, an operation to circulate liquid discharged from the liquid storing chamber 31 back to the liquid storing chamber 31 is executed. This operation will be referred to below as the circulation operation.

The circulation operation is executed concurrently with an operation in which the liquid discharging head 26 discharges ink from the discharge openings 35 under control of the control unit 20 (this operation will be referred to below as the discharge operation). The control unit 20 controls both the circulation operation and the discharge operation. That is, the control unit 20 in the first embodiment functions as a circulation controller that controls the circulation operation and a discharge controller that controls the discharge operation.

The pressure adjustor 47 adjusts the pressure in the liquid storing chamber 31 under control of the control unit 20. An example that may be used as the pressure adjustor 47 is a raising and lowering mechanism that adjusts the pressure of the ink in the liquid storing chamber 31 according to the head by lifting or lowering the storing container 46 in the vertical direction. However, there is no limitation on the specific structure of the pressure adjustor 47. Any of various known mechanisms may be used as the pressure adjustor 47.

As illustrated in FIG. 2, a first flow quantity adjustor 61 and a shut-off valve 71 are provided in the supply flow path 51. Specifically, the first flow quantity adjustor 61 and shut-off valve 71 are disposed in the external supply flow path 43. However, either or both of the first flow quantity adjustor 61 and shut-off valve 71 may be disposed in the internal supply flow path 32 in the liquid discharging head 26.

The first flow quantity adjustor 61 is a mechanism that adjusts the flow quantity of the ink in the supply flow path 51. Specifically, the first flow quantity adjustor 61 includes a first flow path 611, a second flow path 612, and a switching valve 613. The first flow path 611 and second flow path 612 constitute part of the supply flow path 51. The first flow path 611 and second flow path 612 are coupled in parallel to each other. Specifically, the second flow path 612 is a bypass flow path that branches from the first flow path 611 at a specific position and joints the first flow path 611 at a position distant from the specific position toward the liquid storing chamber 31. The second flow path 612 has a higher flow path resistance than the first flow path 611. For example, the second flow path 612 has a smaller flow path area than the first flow path 611.

The switching valve 613 is a valve mechanism that makes a switchover so that the first flow path 611 is opened or closed. The control unit 20 controls the state of the switching valve 613 between an open state in which the first flow path 611 is open and a closed state in which the first flow path 611 is closed. With the switching valve 613 being in the open state, ink to be supplied from the circulating pump 42 to the supply flow path 51 passes through the first flow path 611. With the switching valve 613 being in the closed state, ink to be supplied from the circulating pump 42 to the supply flow path 51 passes through the second flow path 612. Since the second flow path 612 has a higher flow path resistance than the first flow path 611 as described above, the flow velocity V2 of ink supplied from the supply flow path 51 to the liquid storing chamber 31 with the switching valve 613 being in the closed state is lower than the flow velocity V1 of ink supplied from the supply flow path 51 to the liquid storing chamber 31 with the switching valve 613 being in the open state ($V2<V1$).

As understood from the above description, when the control unit 20 causes the switching valve 613 to shift from the open state to the closed state, the flow velocity of ink in the circulation operation is lowered. That is, the control unit 20 lowers the flow velocity of ink in the circulation operation by switching the flow path through which ink passes from the first flow path 611 to the second flow path 612. Another structure may be used in which the valve mechanism for flow quantity adjustment is provided in the second flow path 612 so that the flow quantity in the second flow path 612 can be changed.

The shut-off valve 71 in FIG. 2 is a valve mechanism that makes a switchover so that the supply flow path 51 is opened or closed. The control unit 20 controls the state of the shut-off valve 71 between an open state in which the supply flow path 51 is open and a closed state in which the supply flow path 51 is closed. With the shut-off valve 71 being in the open state, ink expelled from the circulating pump 42 passes through the supply flow path 51 and enters the liquid storing chamber 31. With the shut-off valve 71 being in the closed state, a flow of ink expelled from the circulating pump 42 is blocked by the shut-off valve 71. As understood from the above description, with the shut-off valve 71 being in the open state, the circulation operation is continued, and with the shut-off valve 71 being in the closed state, the circulation operation is stopped. That is, when the control unit 20 causes the shut-off valve 71 to shift from the open state to the closed state, the circulation operation stops. As understood from the above description, the control unit 20 controls the circulation operation by controlling the first flow quantity adjustor 61 and shut-off valve 71.

Figure 5:
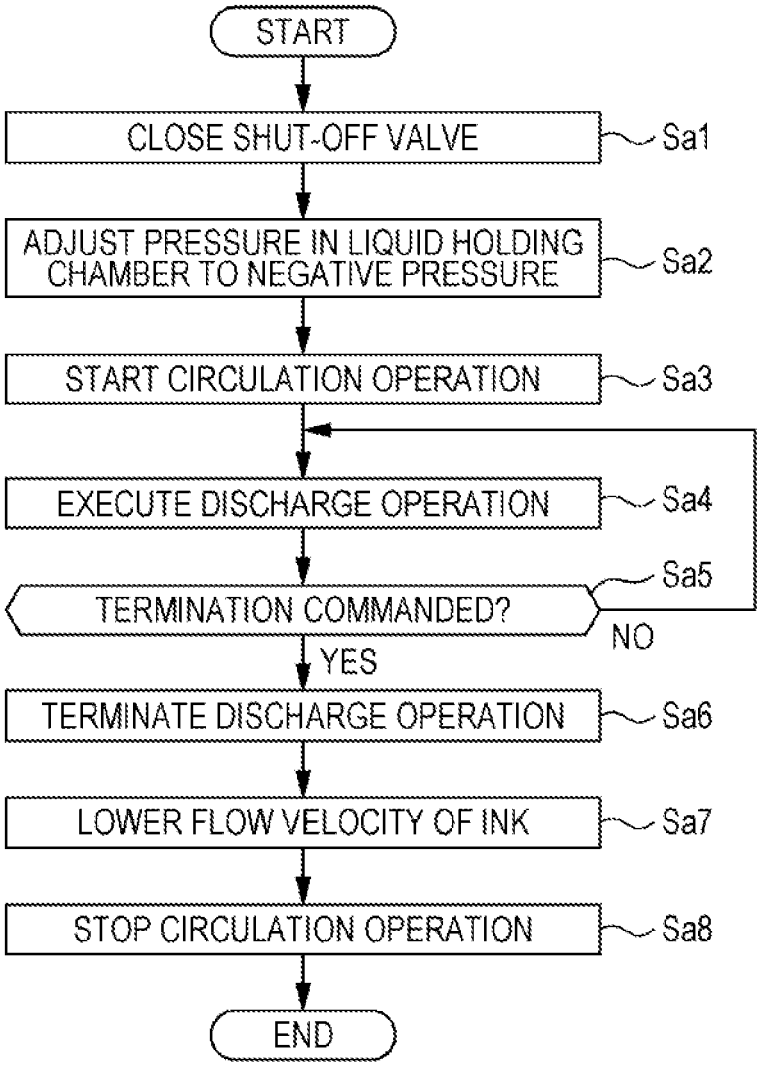
FIG. 5 is a flowchart illustrating a specific procedure in operations of the liquid discharging apparatus.

FIG. 5 is a flowchart illustrating a specific procedure in operations of the liquid discharging apparatus 100A. When the liquid discharging apparatus 100A is powered on or is returned from a standby state, processing in FIG. 5 is started. At the start of processing in FIG. 5, the switching valve 613 is in the open state. In FIGS. 6 to 9, the open state is represented by a figure indicated by reference characters S1 and the closed state is represented by a figure indicated by reference characters S2 as illustrated in, for example, FIG. 6.

Figure 6:
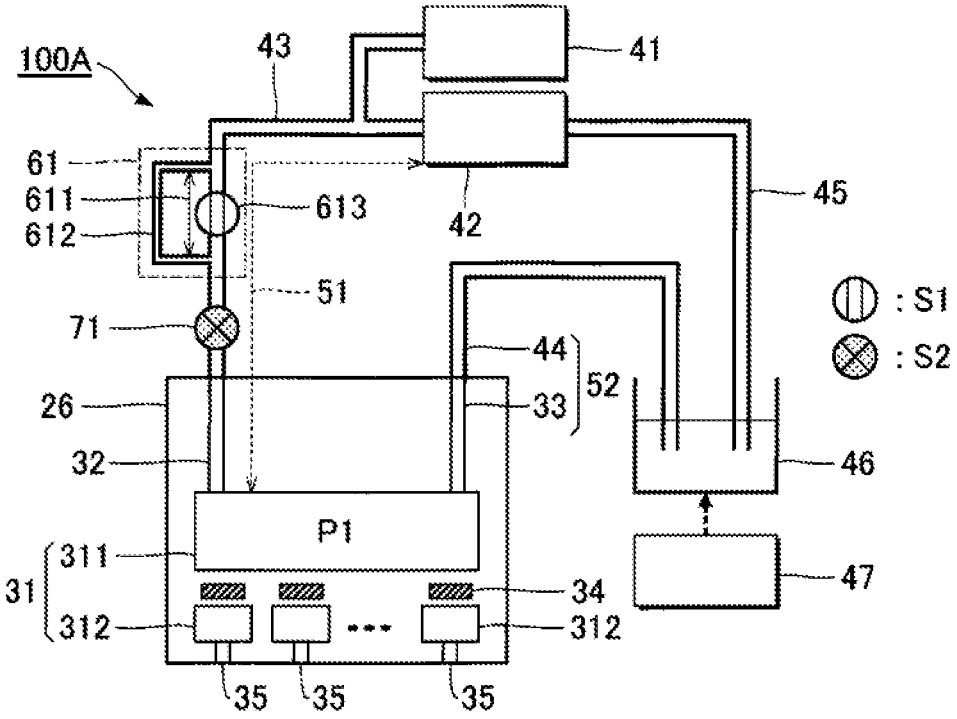
FIG. 6 illustrates an operation state of the liquid discharging apparatus.

The control unit 20 controls the shut-off valve 71 so that it is placed in the closed state as illustrated in FIG. 6 (Sa1). With the shut-off valve 71 kept in the closed state, the control unit 20 controls the pressure adjustor 47 so that the pressure in the liquid storing chamber 31 is adjusted to pressure P1 (Sa2). Pressure P1 is, for example, a negative pressure of about −2.5 kPa.

Figure 7:
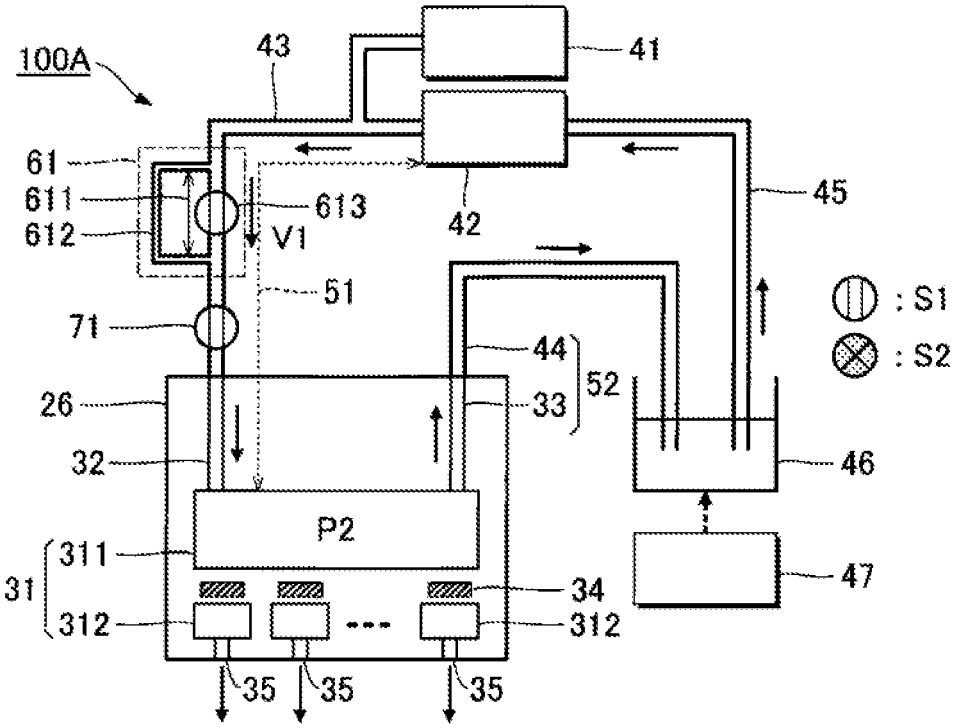
FIG. 7 illustrates another operation state of the liquid discharging apparatus.

The control unit 20 causes the shut-off valve 71 to shift from the closed state to the open state as illustrated in FIG. 7 (Sa3). When the shut-off valve 71 shifts to the open state, the circulation operation starts, by which ink discharged from the liquid storing chamber 31 in the liquid discharging head 26 is circulated back to the liquid storing chamber 31. The switching valve 613 is in the open state, so in the circulation operation, ink that has passed through the first flow path 611 at the flow velocity V1 is supplied to the liquid storing chamber 31. Along with the start of the circulation operation as described above, the pressure in the liquid storing chamber 31 is raised from pressure P1 to pressure P2. Pressure P2 is, for example, a negative pressure of about −1 kPa. That is, the circulation operation is continued in a state in which the interior of the liquid storing chamber 31 is kept at a negative pressure.

While the circulation operation is continued, the control unit 20 causes the liquid discharging head 26 to execute the discharge operation (Sa4). The discharge operation is repeated until its termination is commanded by an external apparatus or the user (No in Sa5). When the termination of the discharge operation is commanded (Yes in Sa5), the control unit 20 causes the liquid discharging head 26 to terminate the discharge operation (Sa6). Since the shut-off valve 71 is kept in the open state as illustrated in FIG. 7, the circulation operation is continued even after the discharge operation has been terminated.

Figure 8:
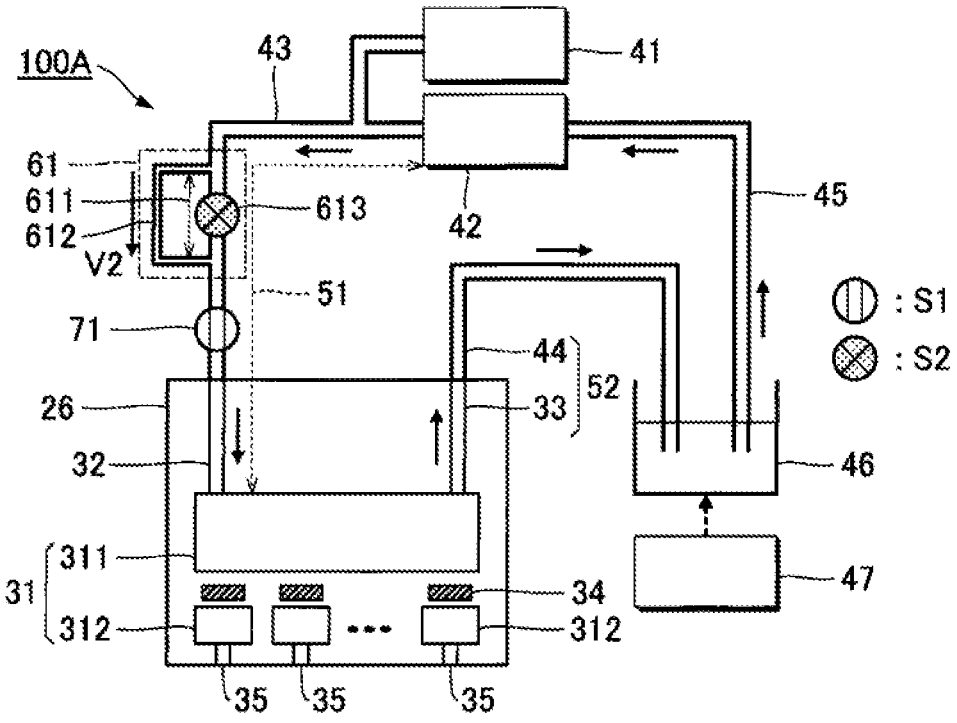
FIG. 8 illustrates yet another operation state of the liquid discharging apparatus.

Upon the completion of the discharge operation, the control unit 20 causes the switching valve 613 to shift from the open state to the closed state (Sa7) as illustrated in FIG. 8. At the point in time at which the switching valve 613 shifts to the closed state, the shut-off valve 71 is kept in the open state. Since the switching valve 613 shifts to the closed state, the ink supplied to the supply flow path 51 shifts from a state in which the ink passes through the first flow path 611 to a state in which the ink passes through the second flow path 612. Therefore, the flow velocity of ink in the circulation operation falls to the flow velocity V2, which is lower than the flow velocity V1 in the circulation operation with the discharge operation being in progress. That is, by switching the flow path through which the ink passes from the first flow path 611 to the second flow path 612, the control unit 20 lowers the flow velocity of ink in the circulation operation. Even after the velocity of the ink has been lowered, the circulation operation is continued.

Figure 9:
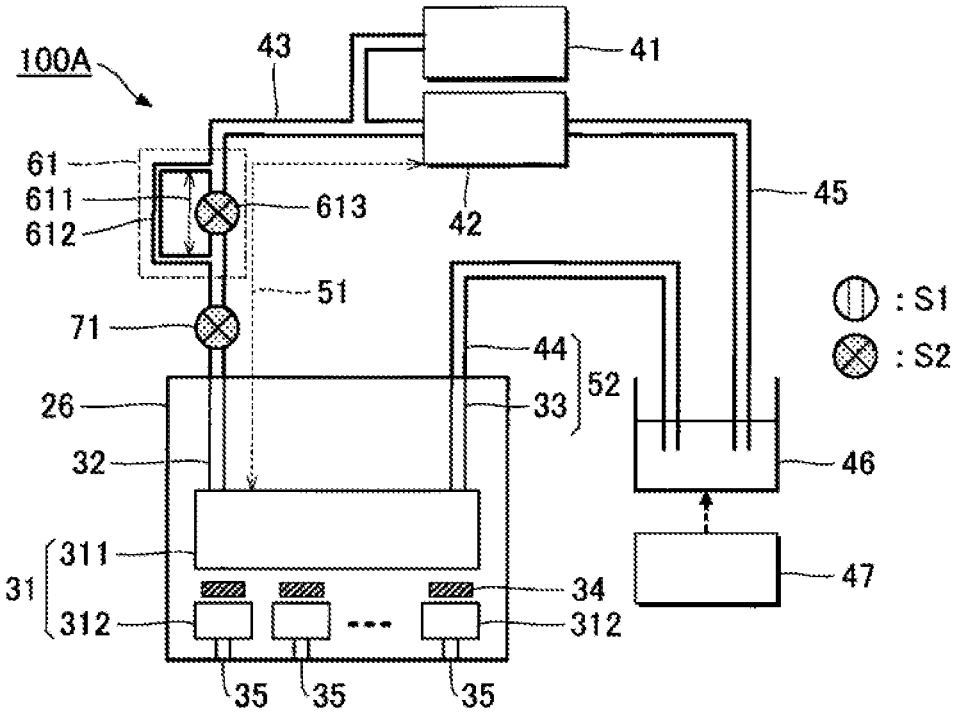
FIG. 9 illustrates still another operation state of the liquid discharging apparatus.

With the switching valve 613 kept in the closed state, the control unit 20 causes the shut-off valve 71 to shift from the open state to the closed state as illustrated in FIG. 9 (Sa8). When the shut-off valve 71 shifts to the closed state, a flow of ink in the circulation operation is blocked, that is, the circulation operation is stopped. As understood from the above description, the control unit 20 in the first embodiment lowers the flow velocity of ink in the circulation operation below the flow velocity V1 of ink in the circulation operation with the discharge operation being in progress, after which the control unit 20 stops the circulation operation.

After the liquid discharging apparatus 100A has been stopped by the procedure described above, when the operations of the liquid discharging apparatus 100A are to be resumed, processing illustrated in FIG. 5 is executed again. Even after the circulation operation has been stopped in step Sa8 in FIG. 5, the operation of the pressure feeding mechanism 41 is continued. Therefore, when the processing in FIG. 5 is started, the circulation operation can be quickly resumed.

In a structure (referred to below as a first comparative example) in which the circulation operation is stopped in a state in which the flow velocity V1 of ink in the circulation operation is kept, an excessively negative pressure may be generated in the liquid storing chamber 31 due to the inertial force of the ink, the inertial force being generated when the circulation operation is stopped. When an excessively negative pressure is generated in the liquid storing chamber 31, outside air is inhaled through the discharge openings 35. This may cause bubbles to enter the ink in the liquid discharging head 26.

As opposed to the first comparative example, in the first embodiment, the flow velocity of ink in the circulation operation is lowered before the circulation operation is stopped. This lowers the ink's inertial force caused when the circulation operation is stopped. In the first embodiment, therefore, the possibility that the pressure in the liquid storing chamber 31 is changed to an excessively negative pressure can be made lower than in the first comparative example. Then, inhalation of outside air through the discharge openings 35 is suppressed, the inhalation being caused by the negative pressure in the liquid storing chamber 31, so the possibility that bubbles enter the ink in the liquid storing chamber 31 can be lowered. As understood from the above description, the operation to lower the flow velocity of ink in the circulation operation is equivalent to an operation to lower the ink's inertial force caused when the circulation operation is stopped.

Second Embodiment

A second embodiment will be described. In exemplary examples below, elements having functions similar to functions in the first embodiment will be given reference numerals used in the description of the first embodiment and detailed descriptions of these elements will be appropriately omitted.

Figure 10:
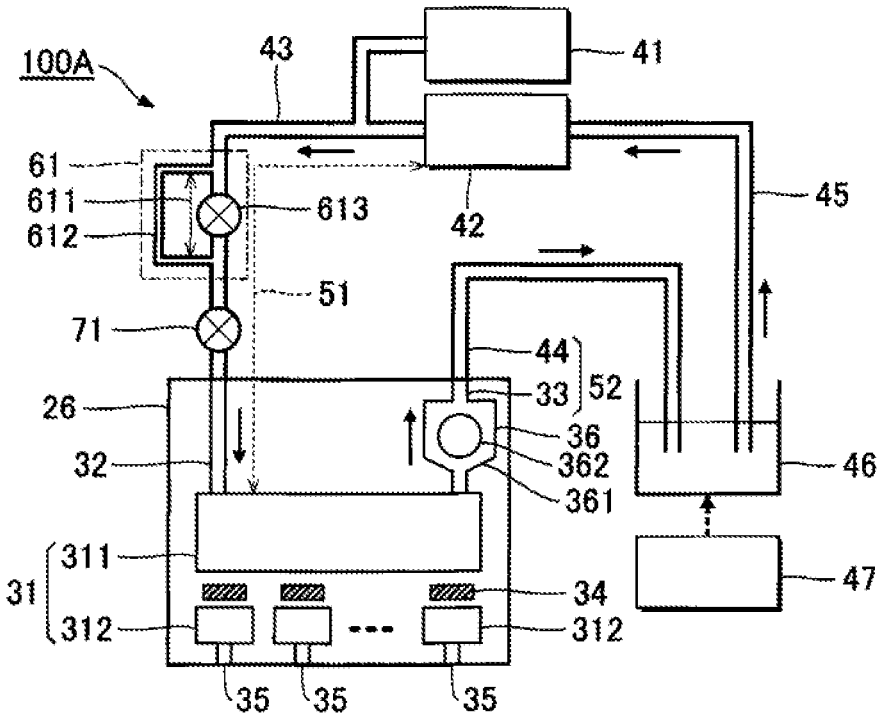
FIG. 10 illustrates ink flow paths in a liquid discharging apparatus in a second embodiment.

FIG. 10 illustrates ink flow paths in a liquid discharging apparatus 100A in a second embodiment. As illustrated in FIG. 10, the liquid discharging apparatus 100A in the second embodiment has a structure in which a backward flow suppressor 36 is added to the liquid discharging apparatus 100A in the first embodiment. The structure excluding the backward flow suppressor 36 and the operation of the liquid discharging apparatus 100A are similar to those in the first embodiment. In the second embodiment as well, therefore, effects are obtained as in the first embodiment.

As illustrated in FIG. 10, the backward flow suppressor 36 is disposed in the discharge flow path 52. In FIG. 10, a structure is illustrated in which the backward flow suppressor 36 is disposed in the internal discharge flow path 33 in the liquid discharging head 26. However, the backward flow suppressor 36 may be disposed in the external discharge flow path 44. The backward flow suppressor 36 is a valve mechanism that suppresses a backward flow of ink. Specifically, the backward flow suppressor 36 passes ink flowing in the forward direction from the liquid storing chamber 31 toward the storing container 46, and passes only a small amount of ink flowing in the backward direction from the storing container 46 toward the liquid storing chamber 31. The backward flow suppressor 36 in the second embodiment has a function that blocks foreign matter that moves in the backward direction. An example that may be used as the backward flow suppressor 36 is a float-type check valve in which a sphere 362 with rigidity is placed in a space in which a pedestal 361 in a tapered shape is formed. A valve mechanism that completely blocks the flow of ink in the backward direction may be used as the backward flow suppressor 36.

In the structure in which the backward flow suppressor 36 is provided, the flow of ink flowing in the backward direction from the storing container 46 toward the liquid storing chamber 31 is suppressed. Therefore, there is the tendency that an outstanding negative pressure is likely to be generated in the liquid storing chamber 31 when the circulation operation is stopped and that a long time is needed to eliminate the negative pressure. In the structure in the second embodiment, therefore, a structure is particularly effective in which an excessively negative pressure in the liquid storing chamber 31 is suppressed by lowering the flow velocity of ink before the circulation operation is stopped. The backward flow suppressor 36 exemplified in the second embodiment is also applied similarly to a third embodiment to a fifth embodiment exemplified below.

Third Embodiment

Figure 11:
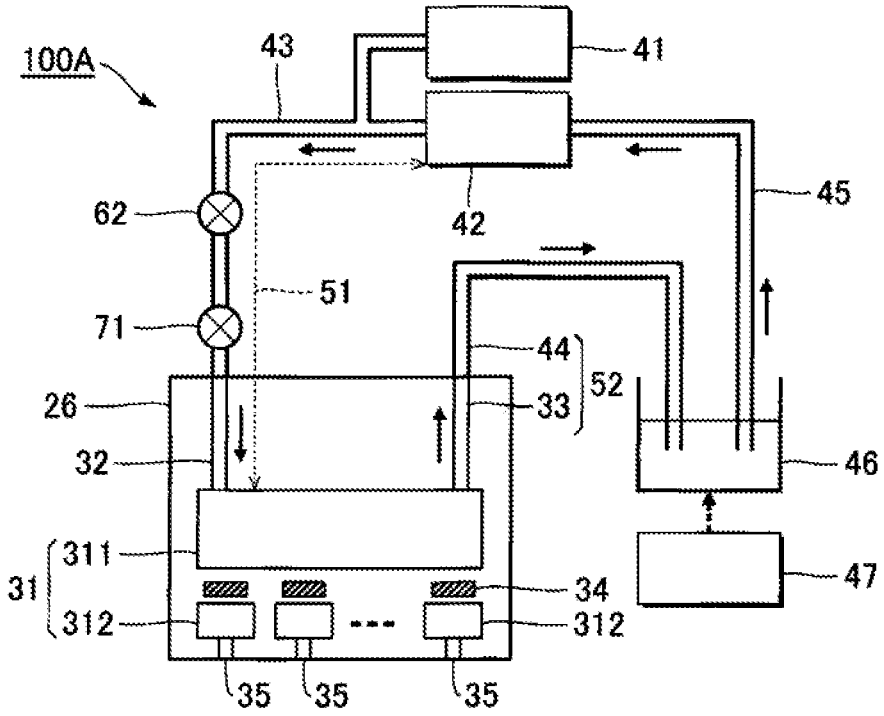
FIG. 11 illustrates ink flow paths in a liquid discharging apparatus in a third embodiment.

FIG. 11 illustrates ink flow paths in a liquid discharging apparatus 100A in a third embodiment. In the third embodiment, the first flow quantity adjustor 61 in the first embodiment is replaced with a second flow quantity adjustor 62, as illustrated in FIG. 11. The second flow quantity adjustor 62 is disposed in the supply flow path 51. Specifically, the second flow quantity adjustor 62 is disposed in the external supply flow path 43. However, the second flow quantity adjustor 62 may be disposed in the internal supply flow path 32 in the liquid discharging head 26.

The second flow quantity adjustor 62 is a valve mechanism that adjusts the flow quantity of the ink in the supply flow path 51. The control unit 20 controls the second flow quantity adjustor 62 so that it adjusts the flow quantity of ink supplied from the supply flow path 51 to the liquid storing chamber 31. The flow velocity of ink in the circulation operation changes according to the flow quantity of the ink in the supply flow path 51. Examples that may be used as the second flow quantity adjustor 62 are a needle valve, having a needle protruding into a flow path, that adjusts the flow quantity when the needle is rotated, a ball valve that adjusts the flow quantity when the angle of a sphere in the flow path is changed, and a tube valve that adjusts the flow quantity when a force with which an elastic tube included in the flow path is pressed is changed.

The control unit 20 in the third embodiment controls the second flow quantity adjustor 62 so that the flow quantity of the ink in the supply flow path 51 is reduced in step Sa7 in FIG. 5. When the flow quantity in the supply flow path 51 is reduced, the flow velocity of ink in the circulation operation is lowered. The control unit 20 controls the second flow quantity adjustor 62 so that the flow velocity of ink in the circulation operation is lowered from the flow velocity V1 to the flow velocity V2 as in the first embodiment. That is, the control unit 20 in the third embodiment lowers the flow velocity of ink in the circulation operation by causing the second flow quantity adjustor 62 to lower the flow quantity in the supply flow path 51. Operations other than in step Sa1 are similar to those in the first embodiment. In the third embodiment as well, therefore, effects are obtained as in the first embodiment.

Fourth Embodiment

Figure 12:
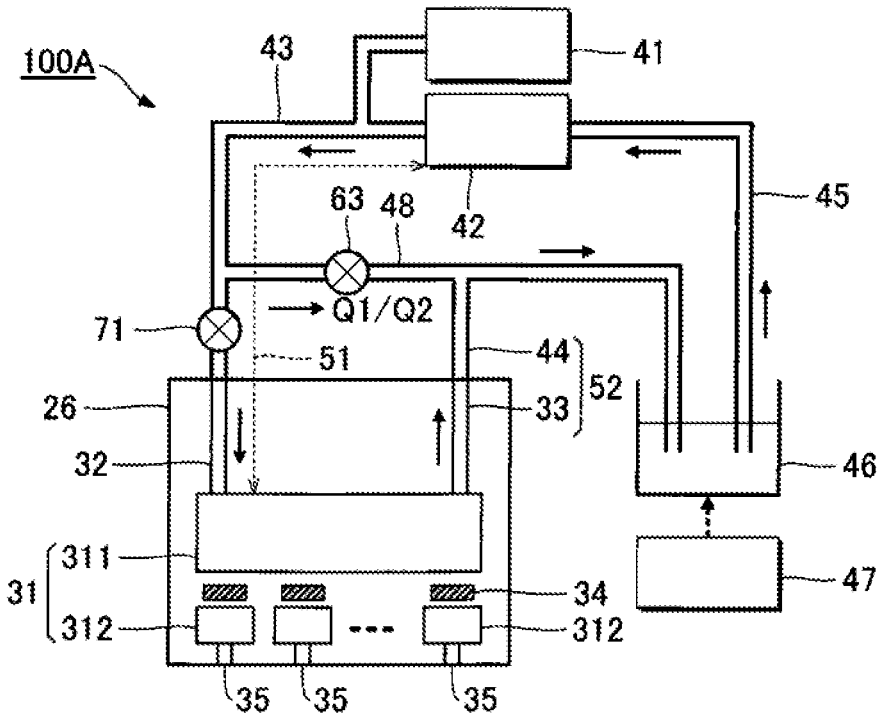
FIG. 12 illustrates ink flow paths in a liquid discharging apparatus in a fourth embodiment.

FIG. 12 illustrates ink flow paths in a liquid discharging apparatus 100A in a fourth embodiment. As illustrated in FIG. 12, the liquid discharging apparatus 100A in the fourth embodiment has a structure in which the first flow quantity adjustor 61 in the first embodiment is omitted and a communication flow path 48 and a third flow quantity adjustor 63 are provided instead.

The communication flow path 48 is a tubular path through which the supply flow path 51 and discharge flow path 52 communicate with each other. Specifically, due to the communication flow path 48, the external supply flow path 43 and external discharge flow path 44 mutually communicate. However, the communication flow path 48 may be formed in the liquid discharging head 26 so that the internal supply flow path 32 and internal discharge flow path 33 communicate with each other.

The third flow quantity adjustor 63 is a valve mechanism that adjusts the flow quantity of the ink in the communication flow path 48. The control unit 20 controls the third flow quantity adjustor 63 so that it adjusts the flow quantity of the ink in the supply flow path 51. As with the second flow quantity adjustor 62, examples that may be used as the third flow quantity adjustor 63 are a needle valve, a ball valve, a tube valve, and other various valve mechanisms. In a structure in which the communication flow path 48 is formed in the liquid discharging head 26, the third flow quantity adjustor 63 is also disposed in the liquid discharging head 26.

The control unit 20 in the fourth embodiment controls the third flow quantity adjustor 63 so that the flow quantity of the ink in the communication flow path 48 is kept at a flow quantity Q1 in a period (Sa3 to Sa6) during which the circulation operation is continued. The flow quantity Q1 is, for example, zero or a small value close to zero. In step Sa7 before the circulation operation is stopped, the control unit 20 controls the third flow quantity adjustor 63 so that the flow quantity of the ink in the communication flow path 48 is increased to a flow quantity Q2. When the flow quantity of ink that flows into the communication flow path 48 through the supply flow path 51 is increased, the flow quantity of ink supplied to the liquid storing chamber 31 through the supply flow path 51 is reduced. When the flow quantity of the ink supplied to the liquid storing chamber 31 is reduced, the flow velocity of ink in the circulation operation is lowered. The control unit 20 controls the third flow quantity adjustor 63 so that the flow velocity of ink in the circulation operation is lowered from the flow velocity V1 to the flow velocity V2 as in the first embodiment. That is, the control unit 20 in the fourth embodiment lowers the flow velocity of ink in the circulation operation by causing the third flow quantity adjustor 63 to raise the flow quantity in the communication flow path 48. Operations other than control for the third flow quantity adjustor 63 are similar to those in the first embodiment. In the fourth embodiment as well, therefore, effects are obtained as in the first embodiment.

Fifth Embodiment

Figure 13:
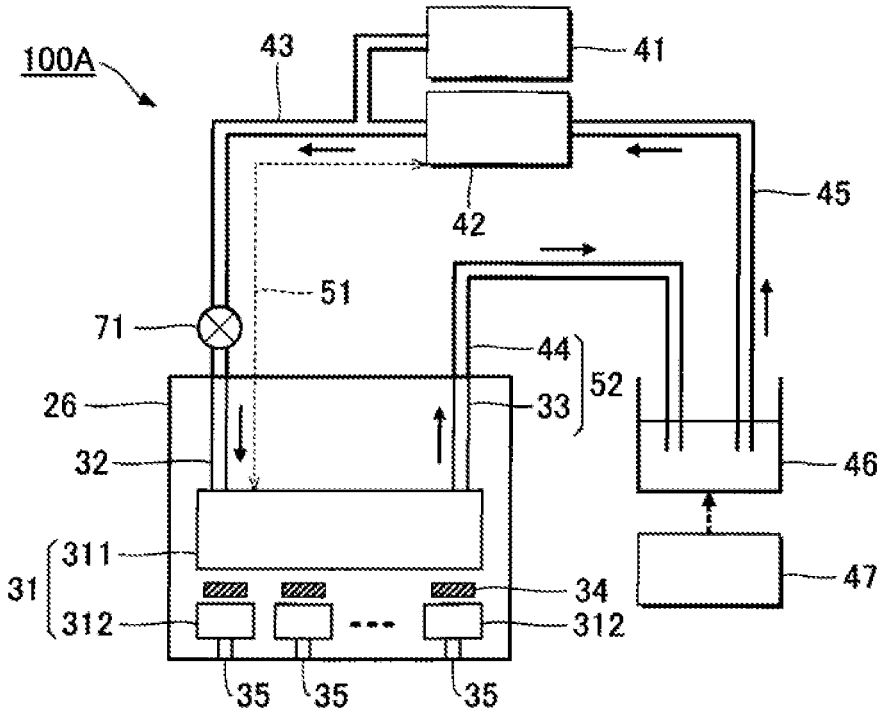
FIG. 13 illustrates ink flow paths in a liquid discharging apparatus in a fifth embodiment.

FIG. 13 illustrates ink flow paths in a liquid discharging apparatus 100A in a fifth embodiment. As illustrated in FIG. 13, the liquid discharging apparatus 100A in the fifth embodiment has a structure in which the first flow quantity adjustor 61 in the first embodiment is omitted.

As described above, ink that has been expelled from the pressure feeding mechanism 41 passes through the supply flow path 51 and is supplied to the liquid storing chamber 31. The flow velocity of ink in the circulation operation depends on pressure applied to the ink by the pressure feeding mechanism 41. The control unit 20 in the fifth embodiment controls the pressure feeding mechanism 41 to control the flow velocity of ink in the circulation operation. Specifically, the control unit 20 lowers pressure applied to ink by the pressure feeding mechanism 41 in step Sa7 in FIG. 5 so that the flow velocity of ink in the circulation operation is lowered from the flow velocity V1 to the flow velocity V2. Operations other than in step Sa7 are similar to those in the first embodiment. In the fifth embodiment as well, therefore, effects are obtained as in the first embodiment.

Sixth Embodiment

Figure 14:
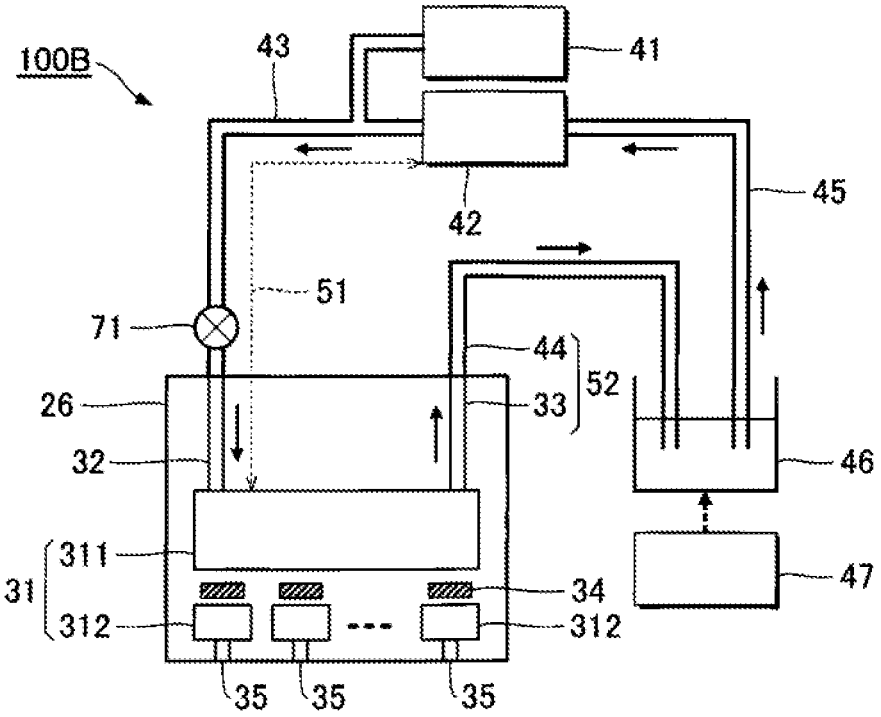
FIG. 14 illustrates ink flow paths in a liquid discharging apparatus in a sixth embodiment.

FIG. 14 illustrates ink flow paths in a liquid discharging apparatus 100B in a sixth embodiment. As illustrated in FIG. 14, the liquid discharging apparatus 100B has a structure in which the first flow quantity adjustor 61 is excluded from the structure of the liquid discharging apparatus 100A in the first embodiment. That is, the liquid discharging apparatus 100B in the sixth embodiment has a liquid discharging head 26, a pressure feeding mechanism 41, a circulating pump 42, an external supply flow path 43, an external discharge flow path 44, a circulation flow path 45, a storing container 46, and a pressure adjustor 47. The structure of each element is similar to a counterpart in the first embodiment.

Figure 15:
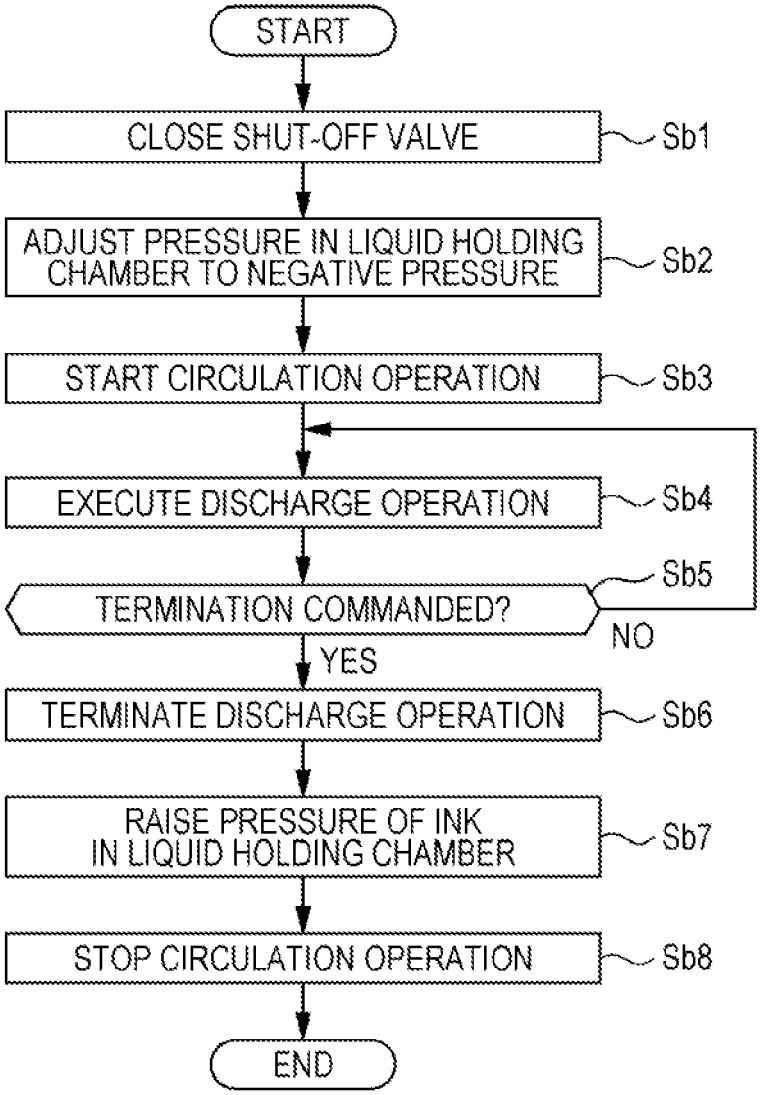
FIG. 15 is a flowchart illustrating a specific procedure in operations of a liquid discharging apparatus in the sixth embodiment.

FIG. 15 is a flowchart illustrating a specific procedure in operations of the liquid discharging apparatus 100B. When the liquid discharging apparatus 100B is powered on or is returned from a standby state, processing in FIG. 15 is started.

Figure 16:
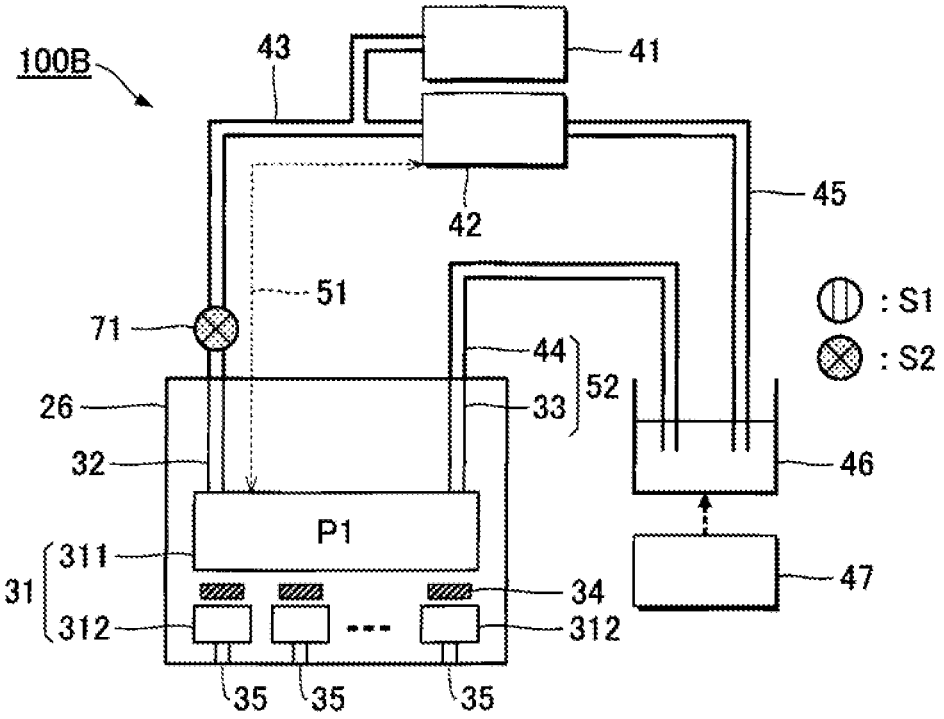
FIG. 16 illustrates an operation state of the liquid discharging apparatus in the sixth embodiment.

The control unit 20 controls the shut-off valve 71 so that it is placed in the closed state as illustrated in FIG. 16 (Sb1). With the shut-off valve 71 kept in the closed state, the control unit 20 controls the pressure adjustor 47 so that the pressure in the liquid storing chamber 31 is adjusted to pressure P1 (Sb2). Pressure P1 is, for example, a negative pressure of about −2.5 kPa.

Figure 17:
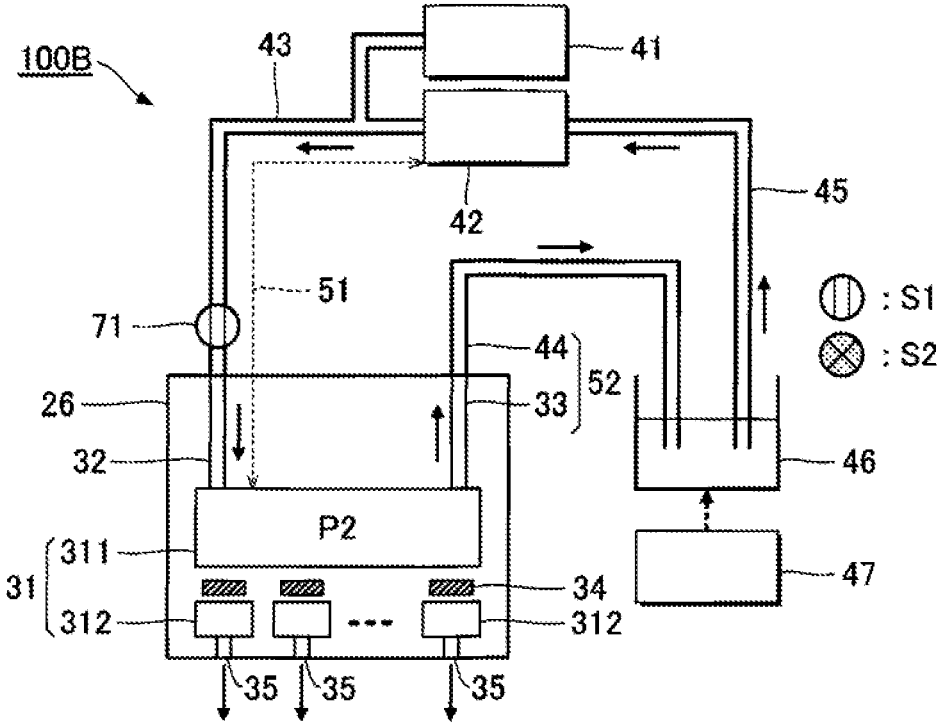
FIG. 17 illustrates an operation state of the liquid discharging apparatus in the sixth embodiment.

The control unit 20 causes the shut-off valve 71 to shift from the closed state to the open state as illustrated in FIG. 17 (Sb3). When the shut-off valve 71 shifts to the open state, a circulation operation starts, by which ink discharged from the liquid storing chamber 31 in the liquid discharging head 26 is circulated back to the liquid storing chamber 31. Along with the start of the circulation operation as described above, the pressure in the liquid storing chamber 31 is raised from pressure P1 to pressure P2. Pressure P2 is, for example, a negative pressure of about −1 kPa. That is, the circulation operation is continued in a state in which the interior of the liquid storing chamber 31 is kept at a negative pressure. Pressure P1 and P2 are set, for example, within a range from −4 kPa to −1 kPa with respect to atmospheric pressure.

While the circulation operation is continued, the control unit 20 causes the liquid discharging head 26 to execute the discharge operation (Sb4). The discharge operation is repeated until its termination is commanded by an external apparatus or the user (No in Sb5). When the termination of the discharge operation is commanded (Yes in Sb5), the control unit 20 causes the liquid discharging head 26 to terminate the discharge operation (Sb6). Since the shut-off valve 71 is kept in the open state as illustrated in FIG. 17, the circulation operation is continued even after the discharge operation has been terminated.

Figure 18:
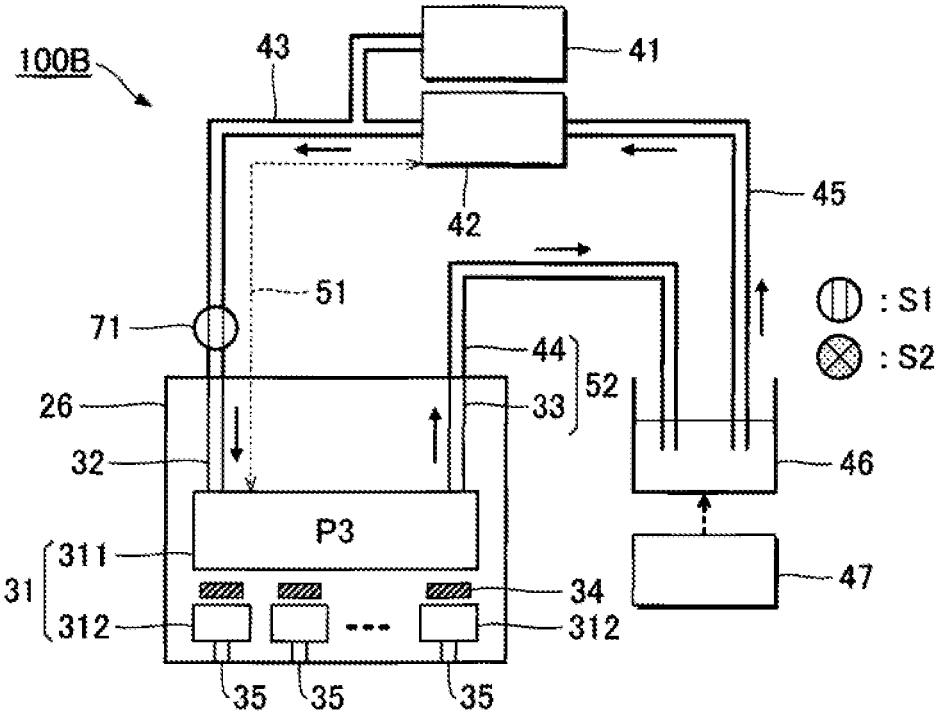
FIG. 18 illustrates an operation state of the liquid discharging apparatus in the sixth embodiment.

Upon the completion of the discharge operation, the control unit 20 controls the pressure adjustor 47 so that the pressure of the ink in the liquid storing chamber 31 is raised to pressure P3 (Sb7) as illustrated in FIG. 18. The pressure adjustor 47 raises the pressure of the ink in the liquid storing chamber 31 to pressure P3 by, for example, lifting the storing container 46 in the vertical direction. Pressure P3 is higher than pressure P2 of the ink in the liquid storing chamber 31 with the discharge operation being in progress. Pressure P3 is set, for example, within a range from 0 kPa to 3 kPa with respect to atmospheric pressure. Pressure P3 is, for example, a positive pressure of about +3 kPa. That is, the pressure of the ink in the liquid storing chamber 31 changes from negative to positive. The circulation operation is continued even after the pressure in the liquid storing chamber 31 has been raised.

Figure 19:
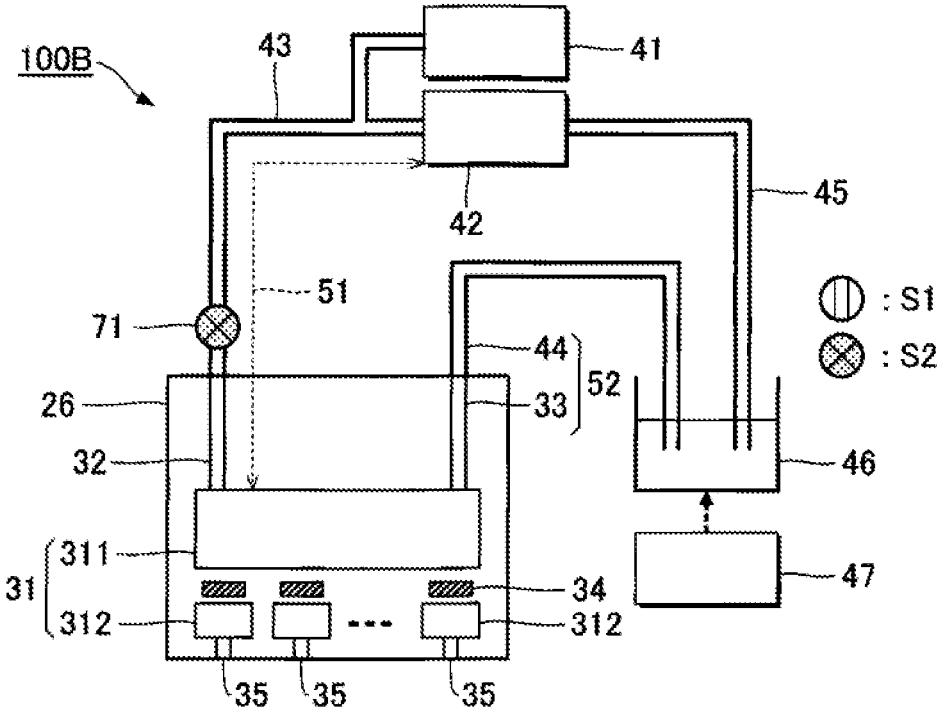
FIG. 19 illustrates an operation state of the liquid discharging apparatus in the sixth embodiment.

With the pressure of the ink in the liquid storing chamber 31 kept at pressure P3, the control unit 20 causes the shut-off valve 71 to shift from the open state to the closed state as illustrated in FIG. 19 (Sb8). When the shut-off valve 71 shifts to the closed state, the circulation operation is stopped. As understood from the above description, the control unit 20 in the sixth embodiment raises the pressure of the ink in the liquid storing chamber 31 above the pressure P2 of the ink in the liquid storing chamber 31 during the discharge operation, after which the control unit 20 stops the circulation operation.

After the liquid discharging apparatus 100B has been stopped by the procedure described above, when the operation of the liquid discharging apparatus 100B is to be resumed, processing illustrated in FIG. 15 is executed again. Even after the circulation operation has been stopped in step Sb8 in FIG. 15, the operation of the pressure feeding mechanism 41 is continued. Therefore, when the processing in FIG. 15 is started, the circulation operation can be quickly resumed.

In a structure (referred to below as a second comparative example) in which the circulation operation is stopped in a state in which the pressure of the liquid storing chamber 31 is kept at pressure P2 with the discharge operation being in progress, an excessively negative pressure may be generated in the liquid storing chamber 31 due to the ink's inertial force generated when the circulation operation is stopped.

As opposed to the second comparative example, in the sixth embodiment, the pressure of the ink in the liquid storing chamber 31 is raised in the circulation operation before the circulation operation is stopped. Therefore, the possibility that the pressure in the liquid storing chamber 31 is lowered to a negative pressure can be reduced when compared with the second comparative example. Then, inhalation of outside air through the discharge openings 35 is suppressed, the inhalation being caused by the negative pressure in the liquid storing chamber 31, so the possibility that bubbles enter the ink in the liquid storing chamber 31 can be lowered. In the sixth embodiment, pressure P in the liquid storing chamber 31 is raised to a positive pressure before the circulation operation is stopped. Even when the stopping of the circulation operation continues for a long time, therefore, inhalation of outside air through the discharge openings 35 is effectively suppressed.

Figure 20:
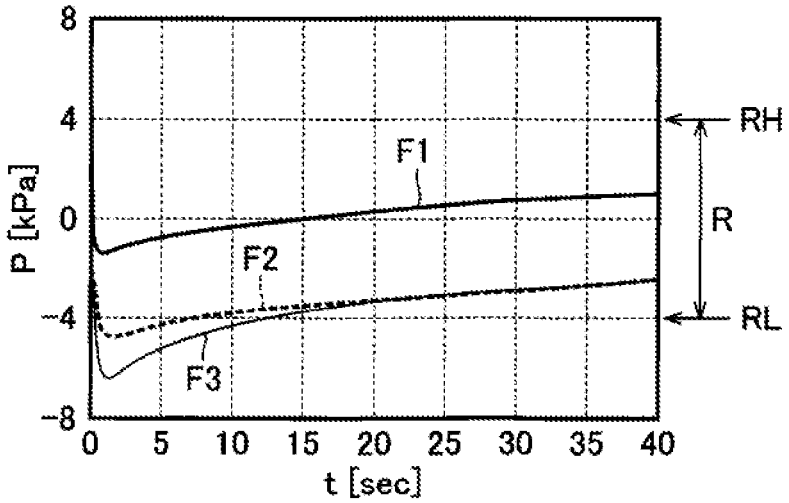
FIG. 20 is a graph representing time-varying changes in pressure in a liquid storing chamber.

FIG. 20 is a graph representing time-varying changes in pressure P in the liquid storing chamber 31 with elapsed time t on the horizontal axis, elapsed time t starting from the point in time at which the circulation operation is stopped. When elapsed time t is zero, the time is equivalent to the point in time at which the shut-off valve 71 is switched from the open state to the closed state in step Sb8 in FIG. 15. FIG. 20 also represents time-varying changes F1 in pressure P in the liquid storing chamber 31 in the sixth embodiment and time-varying changes F2 in pressure P in the second comparative example. FIG. 20 also indicates a range R of pressure P in the liquid storing chamber 31 within which the meniscus of the ink in each discharge opening 35 is maintained. That is, when pressure P in the liquid storing chamber 31 exceeds the upper limit RH of the range R, ink flows out of the discharge openings 35; when pressure P in the liquid storing chamber 31 falls below the lower limit RL of the range R, outside air is inhaled through the discharge openings 35.

In the second comparative example, immediately after the circulation operation has been stopped, pressure P in the liquid storing chamber 31 falls to a negative pressure lower than the lower limit RL of the range R due to the inertial force of ink, as illustrated in FIG. 20. Therefore, the second comparative example is problematic in that outside air is inhaled through the discharge openings 35. In the sixth embodiment, however, pressure P in the liquid storing chamber 31 has been raised to pressure P3 at the point in time at which the circulation operation is stopped. Even when pressure P in the liquid storing chamber 31 is lowered due to the ink's inertial force generated when the circulation operation is stopped, therefore, pressure P is maintained within the range R. As described above, in the sixth embodiment, the possibility that pressure P in the liquid storing chamber 31 falls to a negative pressure is reduced. Therefore, inhalation of outside air through the discharge openings 35 is suppressed, so the possibility that bubbles enter the ink in the liquid storing chamber 31 can be lowered.

When pressure P in the ink in the liquid storing chamber 31 is raised to pressure P3 in step Sb7, the flow velocity of ink and its flow quantity are lowered. In the sixth embodiment, therefore, an operation to raise pressure P in the liquid storing chamber 31 is equivalent to an operation to lower the ink's inertial force generated when the circulation operation is stopped.

Seventh Embodiment

Figure 21:
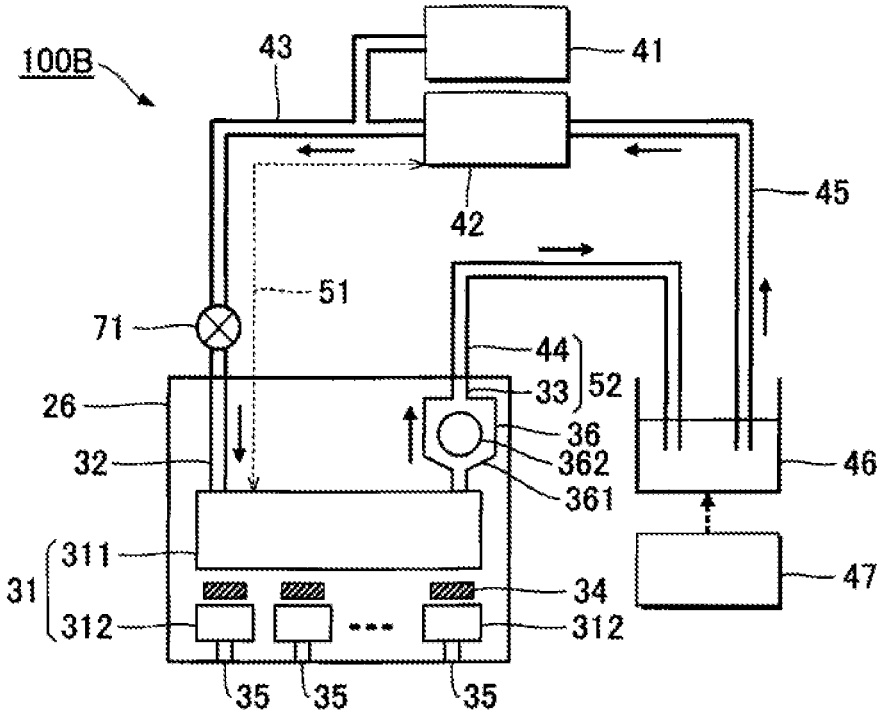
FIG. 21 illustrates ink flow paths in a liquid discharging apparatus in a seventh embodiment.

FIG. 21 illustrates ink flow paths in a liquid discharging apparatus 100B in a seventh embodiment. As illustrated in FIG. 21, the liquid discharging apparatus 100B in the seventh embodiment has a structure in which the backward flow suppressor 36 is added to the liquid discharging apparatus 100B in the sixth embodiment. The structure excluding the backward flow suppressor 36 and the operation of the liquid discharging apparatus 100B are similar to those in the sixth embodiment. In the seventh embodiment as well, therefore, effects are obtained as in the sixth embodiment. The backward flow suppressor 36 is disposed in the discharge flow path 52 to suppress a backward flow of ink, as described in the second embodiment.

In FIG. 20, time-varying changes F3 in pressure P in the liquid storing chamber 31 are also illustrated in a structure (referred to below as a third comparative example) in which the backward flow suppressor 36 is added to the second comparative example described above. In the third comparative example, in which the backward flow suppressor 36 is provided, the tendency is confirmed from FIG. 20 that a more outstanding negative pressure than in the second comparative example is generated in the liquid storing chamber 31 when the circulation operation is stopped and a long time is needed to eliminate the negative pressure. Therefore, the structure in which an excessively negative pressure in the liquid storing chamber 31 is suppressed by raising pressure P before the circulation operation is stopped is particularly effective in a structure in which the backward flow suppressor 36 is provided as in the seventh embodiment. The backward flow suppressor 36 exemplified in the seventh embodiment is similarly applied to an eighth embodiment and a ninth embodiment as well, which will be described below.

Eighth Embodiment

Figure 22:
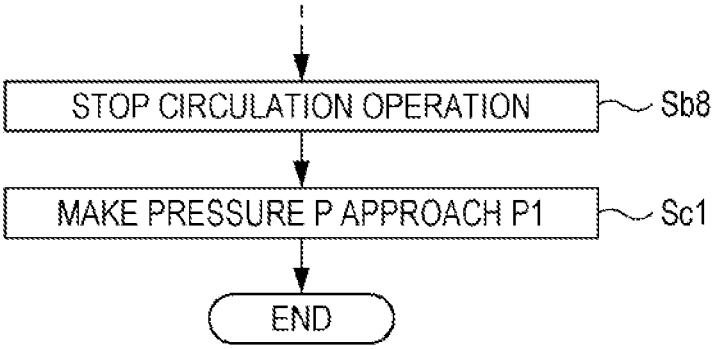
FIG. 22 is a flowchart that exemplifies part of operations of a liquid discharging apparatus in an eighth embodiment.

A liquid discharging apparatus 100B in an eighth embodiment has a structure similar to that in the sixth embodiment. FIG. 22 is a flowchart that exemplifies part of operations of the liquid discharging apparatus 100B in the eighth embodiment. Operations from step Sb1 to Sb8 are similar to the operations described in the sixth embodiment with reference to FIG. 15. In the eighth embodiment as well, therefore, effects are obtained as in the sixth embodiment.

When the circulation operation is stopped in step Sb8, the control unit 20 controls the pressure adjustor 47 so that pressure P in the liquid storing chamber 31 changes to pressure P1, which is pressure before the circulation operation is started, with time (Sc1). Specifically, the pressure adjustor 47 forcibly changes pressure P in the liquid storing chamber 31 to pressure P1 by gradually lowering the storing container 46, which has been lifted in step Sb7, in the vertical direction. For example, the pressure adjustor 47 spends about 40 seconds to gradually change pressure P to pressure P1.

As described above, in the eighth embodiment, after the circulation operation has been stopped, pressure P in the liquid storing chamber 31 changes to pressure P1, which is pressure before the circulation operation is started, with time. This suppresses changes that occur in the pressure in the liquid storing chamber 31 immediately after the circulation operation is stopped. Therefore, it is possible to reduce the possibility that outside air is inhaled through the discharge openings 35 due to an unexpected change in pressure P in liquid storing chamber 31.

Ninth Embodiment

Figure 23:
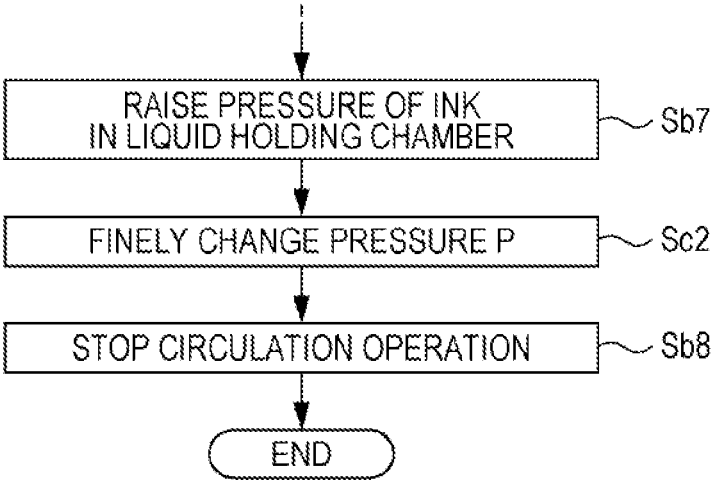
FIG. 23 is a flowchart that exemplifies part of operations of a liquid discharging apparatus in a ninth embodiment.

A liquid discharging apparatus 100B in a ninth embodiment has a structure similar to that in the seventh embodiment. That is, the liquid discharging apparatus 100B in the ninth embodiment has the backward flow suppressor 36. FIG. 23 is a flowchart that exemplifies part of operations of the liquid discharging apparatus 100B in the ninth embodiment. In the ninth embodiment, step Sc2 is added to an operation similar to an operation in the sixth embodiment. Operations other than in step Sc2 are similar to the operations in the sixth embodiment described with reference to FIG. 15. In the ninth embodiment as well, therefore, effects are obtained as in the sixth embodiment.

After pressure P in the liquid storing chamber 31 has been raised in step Sb7, the control unit 20 controls the pressure adjustor 47 so that pressure P is finely changed repetitively in the vicinity of pressure P3, to which pressure P has been raised (Sc2). Specifically, the pressure adjustor 47 periodically changes pressure P in the liquid storing chamber 31 with respect to pressure P3 by vibrating the storing container 46, which has been lifted in step Sb7, in the vertical direction. While pressure P is being changed, the circulation operation is stopped (Sb8).

When pressure P is repetitively changed as described above, the sphere 362 included in the backward flow suppressor 36 repetitively comes into contact with the pedestal 361 and moves away from it. With the sphere 362 distant from the pedestal 361, ink flows backward from the storing container 46 toward the liquid storing chamber 31. This makes it possible to quickly eliminate the negative pressure in the liquid storing chamber 31 brought about immediately after the circulation operation is stopped.

Variations

The embodiments exemplified above can be modified in various ways. Aspects of specific modifications that can be applied to the embodiments described above will be exemplified below. Any two or more aspects selected from exemplary examples described below can be appropriately combined within a range in which any mutual contradiction does not occur.

(1) A combined structure may be formed from the structures in the first to fifth embodiments, in which the flow velocity of ink in the circulation operation is lowered before the circulation operation is stopped and the structures in the sixth to ninth embodiments in which pressure P in the liquid storing chamber 31 is raised before the circulation operation is stopped. In this combined structure, it is possible to more effectively reduce the possibility that pressure P in the liquid storing chamber 31 is changed to an excessively negative pressure.

(2) In each embodiment described above, a pressure sensor that detects pressure P in the liquid storing chamber 31 may be provided. The control unit 20 adjusts pressure P in the liquid storing chamber 31 by controlling the pressure adjustor 47 according to the value detected by the pressure sensor. For example, the control unit 20 controls the pressure adjustor 47 according to the detected value so that pressure P is maintained within the range R exemplified in FIG. 20. In this structure, it is possible to highly precisely maintain pressure P within the range R.

(3) In each embodiment described above, the internal supply flow path 32 and external supply flow path 43 have constituted the supply flow path 51. However, only one of the internal supply flow path 32 and external supply flow path 43 may constitute the supply flow path 51. That is, the internal supply flow path 32 or external supply flow path 43 may be omitted. Also, in each embodiment described above, the internal discharge flow path 33 and external discharge flow path 44 have constituted the discharge flow path 52. However, only one of the internal discharge flow path 33 and external discharge flow path 44 may constitute the discharge flow path 52. That is, the internal discharge flow path 33 or external discharge flow path 44 may be omitted.

(4) The liquid discharging apparatus exemplified in each embodiment described above has been a serial liquid discharging apparatus in which the transporting body 242 to which the liquid discharging head 26 is attached is reciprocated. However, the present disclosure can also be applied to a line liquid discharging apparatus in which a plurality of discharge openings 35 are distributed across the entire width of the medium 12.

(5) The liquid discharging apparatus exemplified in each embodiment described above can be used not only in a device used only for printing but also in any of other various devices such as a facsimile machine or copier. Of course, applications of the liquid discharging apparatus are not limited to printing. For example, a liquid discharging apparatus that discharges a color material solution is used as a manufacturing apparatus that forms color filters for display devices such as liquid crystal display panels. A liquid discharging apparatus that discharges a conductive material solution is used as a manufacturing apparatus that forms wires and electrodes on wiring boards. A liquid discharging apparatus that discharges a bio-organic substance solution is used as a manufacturing apparatus that manufactures biochips.

What is claimed is:

1. A liquid discharging apparatus comprising:

a liquid storing chamber storing a liquid to be discharged from a discharge opening;

a supply flow path supplying the liquid to the liquid storing chamber;

a discharge flow path discharging the liquid from the liquid storing chamber;

a circulation controller controlling a circulation operation to circulate, to the supply flow path, the liquid discharged through the discharge flow path; and a discharge controller controlling a discharge operation to discharge the liquid from the discharge opening;

wherein the circulation controller controls the flow velocity of the circulation operation to be a first flow velocity while the discharge operation is concurrently in progress, wherein the circulation controller lowers the flow velocity of the liquid in the circulation operation to be a second flow velocity that is lower than the first flow velocity when the discharge operation is completed, and wherein after which the circulation controller stops the circulation operation.

2. The liquid discharging apparatus according to claim 1, wherein:

the supply flow path includes a first-common flow path, a first flow path branched from the first-common flow path, a second flow path branched from the first-common flow path, and a second-common flow path communicating with the first flow path and the second flow path; and the circulation controller lowers the flow velocity of the liquid in the circulation operation by switching a flow path through which the liquid passes from the first flow path to the second flow path.

3. The liquid discharging apparatus according to claim 2, wherein a flow path resistance of the second flow path is higher than that of the first flow path.

4. The liquid discharging apparatus according to claim 1, further comprising a flow quantity adjustor adjusting a flow quantity of the ink in the supply flow path, wherein the circulation controller lowers the flow velocity of the liquid in the circulation operation by causing the flow quantity adjustor to lower the flow quantity in the supply flow path.

5. The liquid discharging apparatus according to claim 1, further comprising a pressure feeding mechanism that applies pressure to the liquid to be supplied to the supply flow path, wherein the circulation controller lowers the flow velocity of the liquid in the circulation operation by causing the pressure feeding mechanism to lower the pressure to be applied to the liquid.

6. The liquid discharging apparatus according to claim 1, further comprising a backward flow suppressor disposed in the discharge flow path, the backward flow suppressor suppressing a backward flow of the liquid.

7. The liquid discharging apparatus according to claim 6, wherein the backward flow suppressor is a check valve.

8. A liquid discharging apparatus comprising:

a liquid storing chamber storing a liquid to be discharged from a discharge opening;

a supply flow path supplying the liquid to the liquid storing chamber;

a discharge flow path discharging the liquid from the liquid storing chamber;

a circulation controller controlling a circulation operation to circulate, to the supply flow path, the liquid discharged through the discharge flow path; and a discharge controller controlling a discharge operation to discharge the liquid from the discharge opening;

wherein the circulation controller causes a first inertial force of the liquid to be generated while the discharge operation is in progress, wherein the circulation controller lowers the first inertial force of the liquid to a second inertial force that is lower than the first inertial force when the discharge operation is completed, and wherein after which the circulation controller stops the circulation operation.

9. The liquid discharging apparatus according to claim 8, wherein the circulation controller lowers the inertial force of the liquid to the second inertial force by lowering a flow velocity of the liquid in the circulation operation.

10. The liquid discharging apparatus according to claim 8, wherein the circulation controller lowers the inertial force of the liquid, the inertial force being generated when the circulation operation is stopped, by raising pressure of the liquid in the liquid storing chamber.

11. The liquid discharging apparatus according to claim 8, further comprising a backward flow suppressor disposed in the discharge flow path, the backward flow suppressor suppressing a backward flow of the liquid.

12. The liquid discharging apparatus according to claim 11, wherein the backward flow suppressor is a check valve.

* * * * *